US006064293A

United States Patent [19]

Jungst et al.

[11] Patent Number: 6,064,293

[45] Date of Patent: May 16, 2000

[54] THERMAL FUSE FOR HIGH-TEMPERATURE BATTERIES

[75] Inventors: Rudolph G. Jungst; James R. Armijo, both of Albuquerque, N. Mex.; Darrel R. Frear, Austin, Tex.

[73] Assignee: Sandia Corporation, Albuquerque, N. Mex.

[21] Appl. No.: 08/950,390

[22] Filed: Oct. 14, 1997

[51] Int. Cl.[7] ..... H01H 85/06; H01H 85/044; H01H 85/02

[52] U.S. Cl. ..... 337/290; 337/152; 337/159; 337/160; 337/296

[58] Field of Search ..... 337/152, 159, 337/160, 181, 180, 290, 296, 158; 361/642, 646; 257/665; 29/623

[56] References Cited

U.S. PATENT DOCUMENTS 4,906,962 3/1990 Duimstra .

OTHER PUBLICATIONS

Advertisement, Babcock, Inc., Sheet BR211(Orange, California) product advertisement for U.S. Patent No. 4,906,962.

*Primary Examiner*—Leo P. Picard
*Assistant Examiner*—Anatoly Vortman
*Attorney, Agent, or Firm*—Brian W. Dodson

[57] ABSTRACT

A thermal fuse, preferably for a high-temperature battery, comprising leads and a body therebetween having a melting point between approximately 400° C. and 500° C. The body is preferably an alloy of Ag—Mg, Ag—Sb, Al—Ge, Au—In, Bi—Te, Cd—Sb, Cu—Mg, In—Sb, Mg—Pb, Pb—Pd, Sb—Zn, Sn—Te, or Mg—Al.

8 Claims, 1 Drawing Sheet

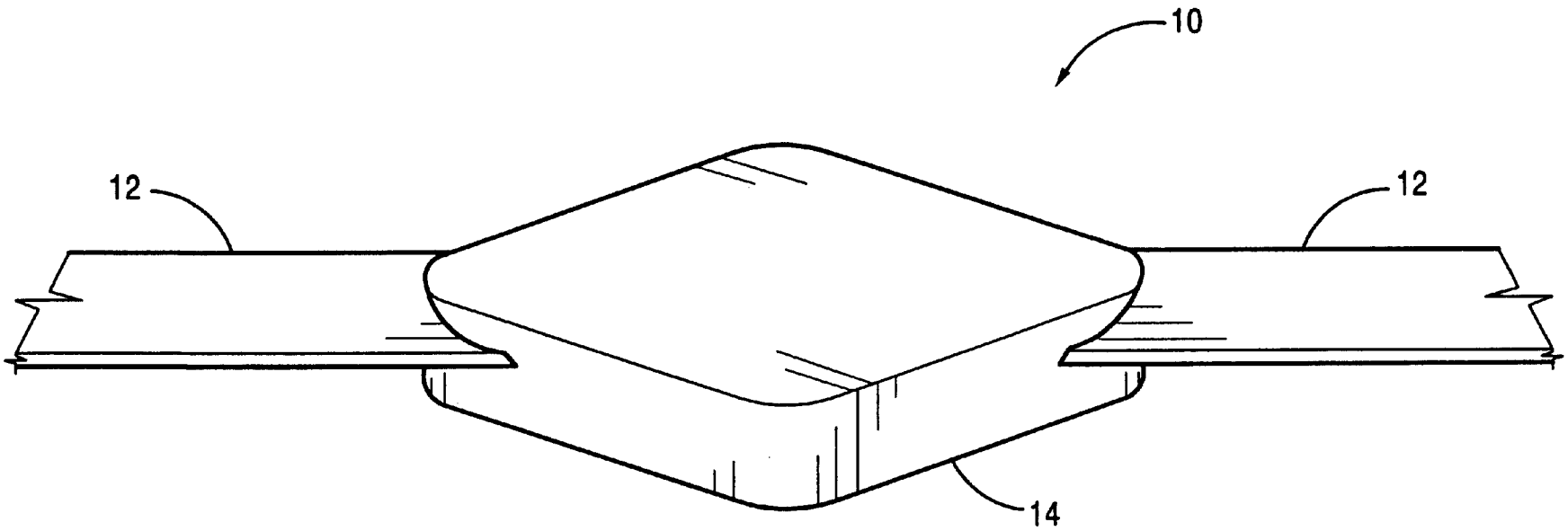
FIGURE

THERMAL FUSE FOR HIGH-TEMPERATURE BATTERIES

GOVERNMENT RIGHTS

The Government has rights to this invention pursuant to Contract No. DE-AC04-94AL85000 awarded by the U.S. Department of Energy.

BACKGROUND OF THE INVENTION

1. Field of the Invention (Technical Field)

The present invention relates to apparatuses and methods for protecting high-temperature batteries from extreme thermal excursions.

2. Background Art

A major problem with high temperature batteries is that they are prone when failing to extreme thermal excursions and resulting catastrophic failure and fire. In large batteries, this can be triggered by short circuit failures of individual cells. As successive cells develop shorts, circulating currents increase in the battery, driving temperatures above normal operating levels. At some point, a cascade effect can develop where the increasing temperature causes more cells to fail. Placing thermal fuses in the battery at the string or bank level can eliminate thermal runaway by opening the affected electrical circuit before the temperature rises high enough to damage cells in adjacent strings. Although some capacity may be lost, the battery does not undergo a thermal meltdown.

Existing thermal cutoff devices are used to protect equipment such as electric motors from overheating. However, these typically operate at temperatures well below the normal operating temperature of a sodium/sulfur battery (350–400° C.) and cannot be modified to survive this higher temperature environment. The highest rated opening temperature known to Applicants for such a device is 240° C. A device which arguably could perform a fusing function at temperatures above 400° C. is the Babcock BR211 fuse switch. However, this switch is a mechanical switch that is activated by a current pulse. It is much more complex than the thermal fuse of the invention and substantially more costly.

SUMMARY OF THE INVENTION (DISCLOSURE OF THE INVENTION)

The present invention is of a thermal fuse comprising leads and a body therebetween having a melting point between approximately 400° C. and 500° C. In the preferred embodiment, the body conducts current without substantially degrading at temperatures between approximately 250° C. to approximately 400° C. The body may be of zinc or an alloy comprising a binary combination of metals such as Ag—Mg, Ag—Sb, Al—Ge, Au—In, Bi—Te, Cd—Sb, Cu—Mg, In—Sb, Mg—Pb, Pb—Pd, Sb—Zn, Sn—Te, or Mg—Al. The alloy is preferably eutectic, and most preferably Mg plus approximately 30.7% by weight Cu, Mg plus approximately 32.3% by weight Al, Sb plus approximately 41.1% by weight Cd, Pb plus approximately 32.6% by weight Mg, or Sb plus approximately 22% by weight Zn, and somewhat less preferably Sb plus approximately 36% by weight Sn. The alloy may comprise a ternary metal. The body may be coated (as with a sol-gel) to reduce chemical reaction of the body with environmental matter. The fuse is preferably suitable for use within a high-temperature battery.

The invention is also of an improvement to high-temperature batteries comprising a thermal fuse comprising leads and a body therebetween. In the preferred embodiment, the body has a melting point between approximately 400° C. and 500° C. and the body conducts current without substantially degrading at temperatures between approximately 250° C. to approximately 400° C. The body may be of zinc or an alloy comprising a binary combination of metals such as Ag—Mg, Ag—Sb, Al—Ge, Au—In, Bi—Te, Cd—Sb, Cu—Mg, In—Sb, Mg—Pb, Pb—Pd, Sb—Zn, Sn—Te, or Mg—Al. The alloy is preferably eutectic, and most preferably Mg plus approximately 30.7% by weight Cu, Mg plus approximately 32.3% by weight Al, Sb plus approximately 41.1% by weight Cd, Pb plus approximately 32.6% by weight Mg, or Sb plus approximately 22% by weight Zn, and somewhat less preferably Sb plus approximately 36% by weight Sn. The alloy may comprise a ternary metal. The body may be coated (as with a sol-gel) to reduce chemical reaction of the body with environmental matter.

A primary object of the present invention is to provide a thermal fuse which will break the electrical circuit upon a component of a high-temperature battery reaching a temperature indicative of failure of the component.

A primary advantage of the present invention is that the fuse materials are inexpensive in comparison to the total cost of a high-temperature battery.

Other objects, advantages and novel features, and further scope of applicability of the present invention will be set forth in part in the detailed description to follow, taken in conjunction with the accompanying drawing, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWING

The accompanying drawing, which is incorporated into and forms a part of the specification, illustrates an embodiment of the present invention and, together with the description, serves to explain the principles of the invention. The drawing is only for the purpose of illustrating a preferred embodiment of the invention and is not to be construed as limiting the invention.

FIG. 1 is a front perspective view of the thermal fuse of the invention.

DESCRIPTION OF THE PREFERRED EMBODIMENTS (BEST MODES FOR CARRYING OUT THE INVENTION)

The thermal fuse of the invention operates by the melting of a fusible material that then falls away from the fuse leads under the influence of gravity to break the electrical circuit at an appropriate temperature. The fusible material is the key component that enables the thermal fuse to operate successfully in a high-temperature battery. It must have a high electrical conductivity in the solid state, melt at a temperature below the damage threshold of the battery cells, exhibit stability at normal battery operating temperatures, have a low enough viscosity when melted to readily drop from the leads, and be reasonably inexpensive to produce because a single battery could employ hundreds of the fuses. Typical operating temperatures are already high for these types of batteries (e.g., 350–400° C. for a sodium/sulfur battery) and so melting points in the 450° C. range are necessary for the fusible material. There are no pure materials that meet all these requirements, although zinc comes closest. Zinc also oxidizes very rapidly near its melting point, which interferes with its functioning as a fuse.

The preferred materials for the fuse of the present invention are solder alloys, prefer eutectic, and preferably binary, that melt over narrow ranges within the correct temperature window and have demonstrated the characteristics set forth in the preceding paragraph. Depending on the type of high-temperature battery being protected, the preferred range for normal operation of the fuse is 250–400° C. and the preferred range for melting is 400–525° C. Preferred alloys include: Sb-41.1 weight % Cd (m.p. 459° C.); Sb-22 weight % Zn (m.p. 510° C.); Pb-32.6 weight % Mg (m.p. 469° C.); and Sb-36 weight % Sn (m.p. 425° C.). The last alloy is not a eutectic composition. Less preferred due to difficulty of fabrication are Mg-30.7 weight % Cu and Mg-32.3 weight % Al.

FIG. 1 shows a teardrop shape fuse 10 of the invention (other shapes, such as oval, are acceptable), comprising leads 12 (such as nickel or gold-plated nickel) and alloy 14. The alloy may be coated with a protective coating (not shown), such as a sol-gel, to protect against oxidation or other chemical reaction which may degrade performance of the fuse. For zinc fuses, tests have shown the tendency of zinc to oxidize at battery operating temperatures and also to oxidize while a cast zinc fuse is functioning, even with sol gel coatings applied to protect the surface. This inhibits the ability of the fuse to function since the oxide material provides enough surface tension to keep the molten zinc from dropping off the fuse leads. However, coatings can provide benefits in certain environments for certain alloys.

The preferred binary alloy constituents for use in the thermal fuse of the invention are: Sb—Cd; Pb—Mg; Sb—Zn; and Sb—Sn. Less preferred binary alloy constituents (with approximate preferred weight percentages and melting temperatures) are: Ag—Mg (48.5–51.5%) (471° C.); Ag—Sb (56–44%) (458° C.) ; Al—Ge (47–53%) (424° C.); Au—In (73–27%) (454° C.); Bi—Te (84.6–15.4%) (413° C.); Cu—Mg (30.7–69.3) (485° C.); In—Sb (20.5–69.5%) (494° C.); Pb—Pd (75–25%) (454° C.); Sn—Te (15–85%) (401° C.); and Mg—Al (67.7–32.3) (437° C.). Ternary or more complex alloys may also function acceptably. Depending on the operating conditions (particularly temperature) of the target battery, one or more of the less preferred alloys may become a preferred alloy for that particular application, as is readily understood by one skilled in the art.

Although particularly useful with the sodium/sulfur battery, the thermal fuse of the invention is useful in any high-temperature battery system. For purposes of the specification and claims, a high-temperature battery is one having a normal interior operating temperature between approximately 250° C. and 400° C. The high-temperature battery undergoing the most active development at the present time is the sodium/nickel chloride battery, which is proposed for use in commercial electric vehicles and in stationary energy storage applications, where its smaller footprint is a valuable benefit.

Industrial Applicability

The invention is further illustrated by the following non-limiting examples directed to the four preferred alloys of the invention:

EXAMPLE 1

The alloy Sb-41.1 Wt. % Cd was evaluated for suitability in the thermal fuse of the invention. The first two tests used alloy made in quartz tubes and the remaining six used alloy made and cast in a glove box with an argon atmosphere. The test temperature in all eight tests was ramped at 10° C./minute to 440° C. with a slower ramp of 1° C./minute to 550° C. A high initial ramp rate allowed quickly reaching a point close to the melting temperature and the slow ramp allowed avoiding overshooting the melting point. All subsequent fusing tests employed this two ramp approach.

Fusing results conducted in air and argon indicated that this composition is susceptible to reaction with oxygen in a manner similar to that observed with zinc. At its melting temperature in air, the molten alloy did not drop off the leads but continued to pass current. However, by increasing the gap width between the leads from 5 mm to 10 mm the fuse did open, although some material adhered to the contacts. Increasing the gap width also lessened the delay between melting and opening of the fuse. A drawback of this alloy is the toxicity of Cd, which is similar to that of Pb.

EXAMPLE 2

The alloy Sb-22 Wt. % Zn was evaluated for suitability in the thermal fuse of the invention. For the fusing tests, the temperature was initially ramped at 10° C./minute to 480° C. and then at 1° C./minute to 580° C. Four fusing tests were conducted with this composition. The first two were run with an alloy made via the quartz tube method. The remaining two used an alloy made and cast in the glove box. Baseline resistance values for fuses made with this alloy were approximately 4 milliohms for the alloy made in the glove box and 20 milliohms for the alloy made via the quartz tube approach. Gold-plated nickel leads were used, the gap width between the leads and the insertion depth being 5 mm. Two fusing tests were run in air with approximately 2 amps of current flowing through the fuse. The first test was inconclusive because of a power lead break. The second fuse melted, but held together and continued to pass current. Suspecting that oxidation was a problem, two additional tests were performed in a glove box to eliminate oxygen interaction. The fuses in these tests melted but a bridge remained between the leads and the fuse continued to pass current. The zinc in this alloy likely increases its tendency to oxidize and this prevents the fuse from opening. A greater gap width may improve performance, as with the alloy of Example 1.

EXAMPLE 3

The alloy Pb-32.6 Wt. % Mg was evaluated for suitability in the thermal fuse of the invention. Magnesium chips were melted in high density alumina crucibles and the solidified magnesium was difficult to remove from the alumina crucible, probably due to Mg reaction with the alumina at the melting point of Mg. All the alloy samples used in these tests were prepared and the fuses cast in the glove box. Baseline resistance of all these fuses prior to testing was approximately 2.7 milliohms.

Eight fusing tests were conducted. The test temperature was initially ramped at 10° C./minute to 430° C. and then at 1° C./minute to 475° C. The current flow was approximately 1 amp for all tests. In all five of the tests conducted in air, the fuse alloy flash oxidized, briefly generating temperatures anywhere from 700° C. to 1570° C. Less than one minute after the fuse flashed, the fuse opened. In order to verify that the flashing of this alloy was due to reaction with oxygen, the remaining three tests were performed in a glove box. The flashing effect observed in air was absent in the glove box tests.

EXAMPLE 4

The alloy Sb-36 Wt. % Sn was evaluated for suitability in the thermal fuse of the invention. It is not a eutectic composition. It was hypothesized that the high Sn content of the alloy would assist in the wetting and melting characteristics. It was also thought that the melting temperature (liquidus temperature) of the alloy could be adjusted through ternary alloy additions.

In test #1, the fuse melted but the alloy did not drop from the leads. In test #2, the fuse body was oriented upside down in the test fixture so that gravity would cause the alloy to more readily fall once the melting occurred. The alloy did indeed fall, but did not form a puddle, and essentially retained its cast shape. This fuse was observed periodically while still being heated in the fixture and was probed with a glass rod to see if it was adhering to the contact lead in a molten state. Upon touching, it was determined that the fuse was still solid but had started to melt because it moved slightly when probed. It is believed that the fuse body was loosened enough by being probed to cause it to fall off sometime later. In tests #3–5, the gap width was increased from 5 mm to 10 mm. The fuses opened in these tests, but there remained a significant amount of material still adhering to the leads. In test #6, some of the alloy dropped but the remainder formed a bridge and continued to pass current. Tests #7–12 all showed a tendency for the contact leads to migrate out of the fuse body and the fuse did not open. It is believed that additions of ternary materials to the alloy will permit both raising of melting temperature and lessening of softening below the melting point.

The preceding examples can be repeated with similar success by substituting the generically or specifically described reactants and/or operating conditions of this invention for those used in the preceding examples.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A thermal fuse comprising leads and a body therebetween having a melting point between approximately 400° C. and 500° C. and comprising Sb and approximately 36% by weight Sn.

2. The fuse of claim 1 wherein said body also comprises a metal selected from the group consisting of Ag, Bi, Cd, Cu, In, Mg, Pb, Pd, Te, and Zn.

3. The fuse of claim 1 wherein said body is coated.

4. The fuse of claim 1 wherein said body is coated with a sol-gel.

5. In a high-temperature battery, a thermal fume comprising leads and a body therebetween having a melting point between approximately 400° C. and 500° C. and comprising Sb and approximately 36% by weight Sn.

6. The fuse of claim 5 wherein said body further comprises a metal selected from the group consisting of Ag, Bi, Cd, Cu, In, Mg, Pb, Pd, Te, and Zn.

7. The fuse of claim 5 wherein said body is coated.

8. The fuse of claim 5 wherein said body is coated with a sol-gel.

* * * * *